US011660905B2

(12) United States Patent
Jae

(10) Patent No.: US 11,660,905 B2
(45) Date of Patent: May 30, 2023

(54) BALL PEN TIP MANUFACTURING MACHINES, BALL PEN TIPS, AND BALL PENS

(71) Applicants: Kotobuki & Co. Ltd., Saitama (JP); Suhan Corporation, Hoengseong-gun (KR); Microtip Co., Ltd., Bucheon-si (KR)

(72) Inventor: Byun Young Jae, Bucheon-si (KR)

(73) Assignees: KOTOBUKI & CO. LTD., Kawagoe-shi (JP); SUHAN CORPORATION, Gangwon-Do (KR); MICROTIP CO., LTD., Bucheon-si (KR)

( * ) Notice: Subject to any disclaimer, the term of this patent is extended or adjusted under 35 U.S.C. 154(b) by 563 days.

(21) Appl. No.: 16/568,057

(22) Filed: Sep. 11, 2019

(65) Prior Publication Data

US 2021/0070094 A1 Mar. 11, 2021

(51) Int. Cl.

| | |
|---|---|
| ***B43K 15/00*** | (2006.01) |
| ***B43K 7/00*** | (2006.01) |
| ***B26F 1/44*** | (2006.01) |
| ***B21D 53/76*** | (2006.01) |

(52) U.S. Cl.

CPC ..... *B43K 15/00* (2013.01); *B26F 1/44* (2013.01); *B43K 7/00* (2013.01); *B21D 53/76* (2013.01)

(58) Field of Classification Search

CPC . B43K 1/086; B43K 1/088; B26F 1/14; B26F 2001/4481; B23P 19/048; B26D 3/001

See application file for complete search history.

(56) References Cited

U.S. PATENT DOCUMENTS

| | | | | | |
|---|---|---|---|---|---|
| 2,646,761 | A * | 7/1953 | Knobel | ..... | B21D 53/76 29/441.1 |
| 3,554,660 | A * | 1/1971 | Woods | ..... | B43K 7/00 401/214 |
| 4,198,172 | A * | 4/1980 | Meislik | ..... | B43K 1/086 401/214 |
| 4,231,146 | A * | 11/1980 | Nakagawa | ..... | B43K 1/08 29/445 |

(Continued)

FOREIGN PATENT DOCUMENTS

| | | | | | |
|---|---|---|---|---|---|
| JP | 2000-203187 | A | 7/2000 | | |
| KR | 200240694 | Y1 * | 10/2001 | ..... | B43K 1/088 |
| WO | WO-9938710 | A1 * | 8/1999 | ..... | B43K 1/086 |

OTHER PUBLICATIONS

Indian Office Action dated Aug. 11, 2021, in Indian Patent Application No. 202014015710, with an English translation thereof.

*Primary Examiner* — David P Angwin
*Assistant Examiner* — Bradley S Oliver
(74) *Attorney, Agent, or Firm* — McGinn I.P. Law Group, PLLC.

(57) ABSTRACT

A method for manufacturing a ball pen tip, in which a spring for biasing a ball is assembled to the ball pen tip, includes punching the ball pen tip by a punch from a rear end of the ball pen tip along a central axis direction of the ball pen tip to form a plastic flow ridge formed by plastic flow upheaving radially inward from an inner peripheral wall surface of the ball pen tip to assemble the spring to the ball pen tip by the plastic flow ridge.

18 Claims, 3 Drawing Sheets

(56) References Cited

U.S. PATENT DOCUMENTS

| | | | | |
|---|---|---|---|---|
| 4,526,077 | A * | 7/1985 | DeGuvera | B21D 28/34<br>83/698.91 |
| 5,957,609 | A * | 9/1999 | Morita | A45D 34/042<br>401/214 |
| 6,299,375 | B1 * | 10/2001 | Abe | B43K 1/086<br>401/214 |
| 9,744,581 | B2 * | 8/2017 | Bullard | B26F 1/36 |
| 10,836,204 | B1 * | 11/2020 | Jae | B21K 25/00 |
| 2007/0261459 | A1 | 11/2007 | Jones | |

* cited by examiner

BALL PEN TIP MANUFACTURING MACHINES, BALL PEN TIPS, AND BALL PENS

FIELD

The embodiments discussed herein relate to methods for manufacturing ball pen tips, ball pen tip manufacturing machines implementing the methods, ball pen tips manufactured by the methods and ball pens including the ball pen tips.

BACKGROUND

Conventionally, a tip for a ball-type liquid container rotatably holding an application ball in a holder of the tip, wherein the tip includes a spring compressed by a writing pressure, a protruding portion formed on the front end of the spring presses the ball through a liquid guiding hole formed in the tip, and the tip includes a swaged portion formed by swaging a rear end of the holder has been known (e.g., in paragraph 0007 in Japanese Patent Application Publication No. 2000-203187, hereinafter, referred as Patent Document 1). In the ball pen tip disclosed in Patent Document 1, an outer diameter of an end coil portion formed on a rear end of the spring to be assembled by swaging in the ball pen tip may be larger than an outer diameter of a central constant coiling portion of the spring. According to the configuration, gravitational self-alignment of the spring can be achieved by hanging the end coil portion of the spring that enables assembly of the ball pens using an automatic assembling machine.

However, conventionally, there has been a desire to provide methods for manufacturing ball pen tips that are more productive than conventional methods, ball pen tip manufacturing machines implementing such manufacturing methods, and ball pen tips and ball pens manufactured by such manufacturing methods.

SUMMARY

In one exemplary aspect of the present invention, a method for manufacturing a ball pen tip in which a spring for biasing a ball is assembled to the ball pen tip includes punching the ball pen tip by a punch from the rear end of the ball pen tip along a central axis direction of the ball pen tip to form a plastic flow ridge formed by plastic flow upheaving radially inward from an inner peripheral wall surface of the ball pen tip to assemble the spring to the ball pen tip by the plastic flow ridge.

In another exemplary aspect of the present invention, a ball pen tip manufacturing machine implements the method for manufacturing a ball pen tip.

In other exemplary aspects of the invention, the ball pen tip is manufactured by the method for manufacturing a ball pen tip.

In yet other exemplary aspects of the invention, a ball pen includes the ball pen tip.

In the above-mentioned exemplary embodiments, a method for manufacturing a ball pen tip that is more productive than conventional methods, a ball pen tip manufacturing machine implementing such manufacturing method, and a ball pen tip and a ball pen, manufactured by such manufacturing method, can be provided.

The present invention will become more fully understood from the detailed description given hereinbelow. The other applicable fields will become apparent with reference to the detailed description given hereinbelow. However, the detailed description and the specific exemplary embodiment are illustrated of desired embodiments of the present invention and are described only for the purpose of explanation. Various changes and modifications will be apparent to those ordinarily skilled in the art on the basis of the detailed description. The applicant has no intention to give to the public any disclosed embodiments. Among the disclosed changes and modifications, those which may not literally fall within the scope of the present claims constitute, therefore, a part of the present invention in the sense of doctrine of equivalents.

BRIEF DESCRIPTION OF DRAWINGS

The exemplary aspects of the invention will be better understood from the following detailed description of the exemplary embodiments of the invention with reference to the drawings in which.

DESCRIPTION OF EXEMPLARY EMBODIMENTS

Figure 1:
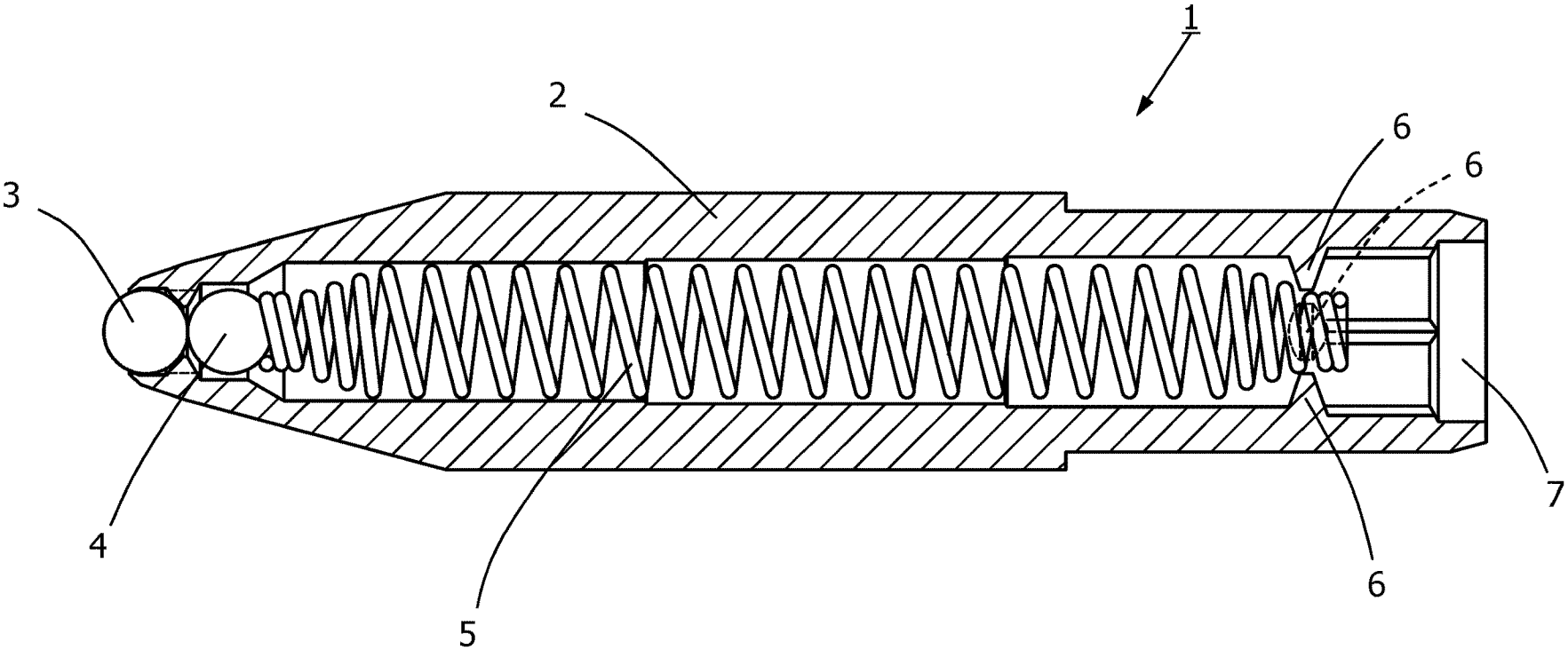
FIG. 1 is a cross-sectional view illustrating a ball pen tip manufactured by a manufacturing method according to an exemplary embodiment.

FIG. 1 is a cross-sectional view illustrating ball pen tip 1 manufactured by a manufacturing method according to the exemplary embodiment. The ball pen tip 1 is attached to a tip of an arbitrary ink tank filled with ink, configuring an arbitrary ball pen refill. Arbitrary ball-point pen inks, gel inks, or roller-ball pen inks can be used as the ink. The ball pen refill having the ball pen tip 1 attached thereto is assembled to an arbitrary writing instrument, which is then used as a ball pen. The ball pen tip 1 includes a ball pen tip body 2, a writing ball 3, a pressing ball 4, and a spring 5. The ball pen tip body 2 is formed by cutting a piece of any metal, such as stainless steel, into a tapered tube. In another exemplary embodiment, an arbitrary resin with plasticity may be used instead of the metal.

A ball housing for holding the writing ball 3 is formed at one end of the ball pen tip body 2. After the writing ball 3 is put inside the ball housing of the ball pen tip body 2, the tip of the ball pen tip body 2 is swaged radially inward. In this manner, the writing ball 3 is assembled to the ball pen tip body 2. In the following description, the end of the ball pen tip body 2, at which the writing ball 3 is assembled, is referred to as a front end of a longitudinal axis (often simply called "axis") of the substantially tube-shaped ball pen tip body 2, and the other side is referred to as a rear end.

Additionally, the pressing ball 4 and the spring 5 are housed inside the ball pen tip 1. The spring 5, which is a coil spring, biases the pressing ball 4 forward with respect to the ball pen tip body 2, and then the pressing ball 4, biased by the spring 5, presses the writing ball 3 forward. According to such a configuration, a spherical surface of the pressing ball 4 can press the center of the writing ball 3 forward along the axis. Thus, compared to a configuration of a conventional pen in which the writing ball 3 is pressed forward by an offset front end of a wire of a coil spring, smoother writing without a sense of being dragged (i.e., "seemingly effortless writing") can be achieved. Since the writing ball 3, pressed by the pressing ball 4, slightly moves back and forth along the direction of the axis, the ball pen tip 1 can adequately release the ink from the tip thereof, thereby preventing undesired ink leakage.

The spring 5 has a central portion having substantially a constant outer diameter and is wound in such a manner that a front end and a rear end of the spring 5 have the same tapered external shape while interposing the central portion therebetween. According to this configuration, the spring 5 can be assembled to the ball pen tip 1 without distinguishing an assembly direction (e.g., front-rear direction) of the spring 5. Thus, the aforementioned configuration can improve the productivity, as compared to a configuration of a conventional pen in which a coil spring having varying shapes at front and rear ends thereof is wound and assembled to a ball pen tip. By feeding the spring 5 to the production line using a parts feeder or the like, for example, efficient production using an automated assembly apparatus can be achieved.

Figure 2:
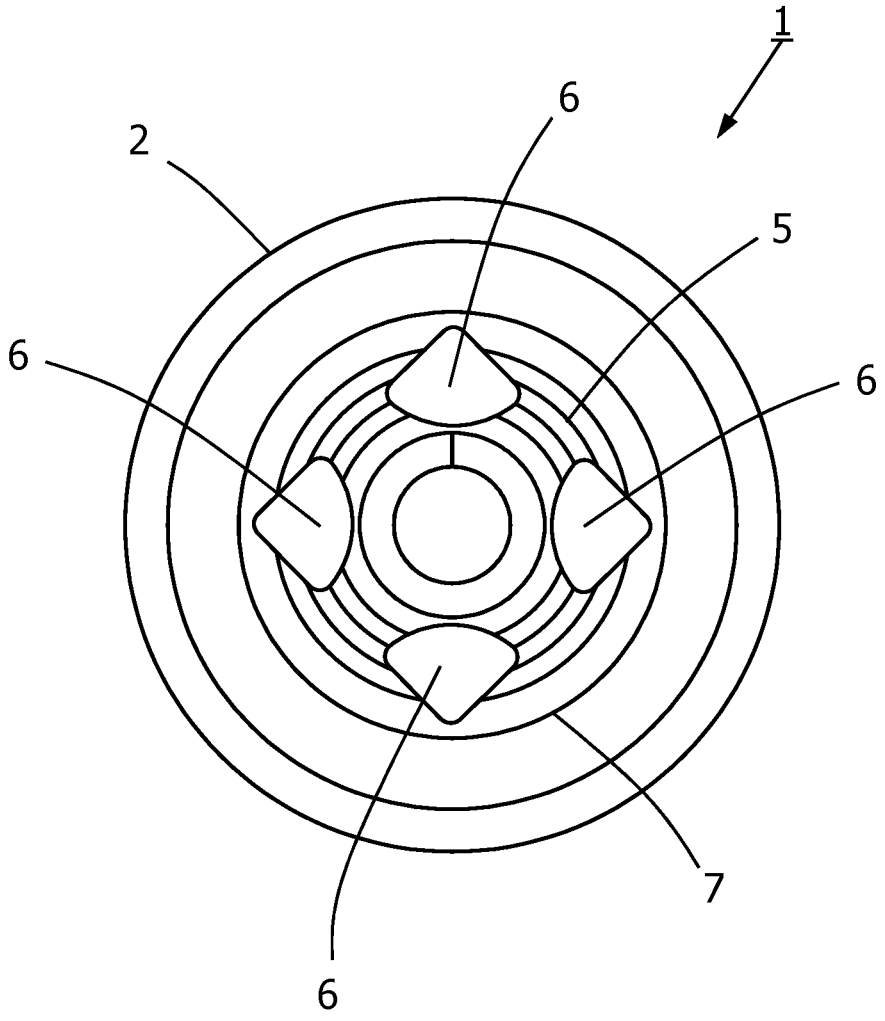
FIG. 2 illustrates the ball pen tip of FIG. 1 as viewed from a rear end thereof.

A process for manufacturing the ball pen tip 1 is now described with reference to FIGS. 1, 2 and 3. First, the writing ball 3 is assembled by swaging to a front end of the ball pen tip body 2. Next, from a rear end opening of the ball pen tip body 2, the pressing ball 4 and the spring 5 are inserted into the ball pen tip body. Here, the productivity can be further improved, by placing the rear end opening of the ball pen tip body 2 vertically upward and then inserting the pressing ball 4 and the spring 5 into the ball pen tip body 2 by allowing the pressing ball 4 and the spring 5 to drop freely into the ball pen tip body 2, for example.

Figure 3:
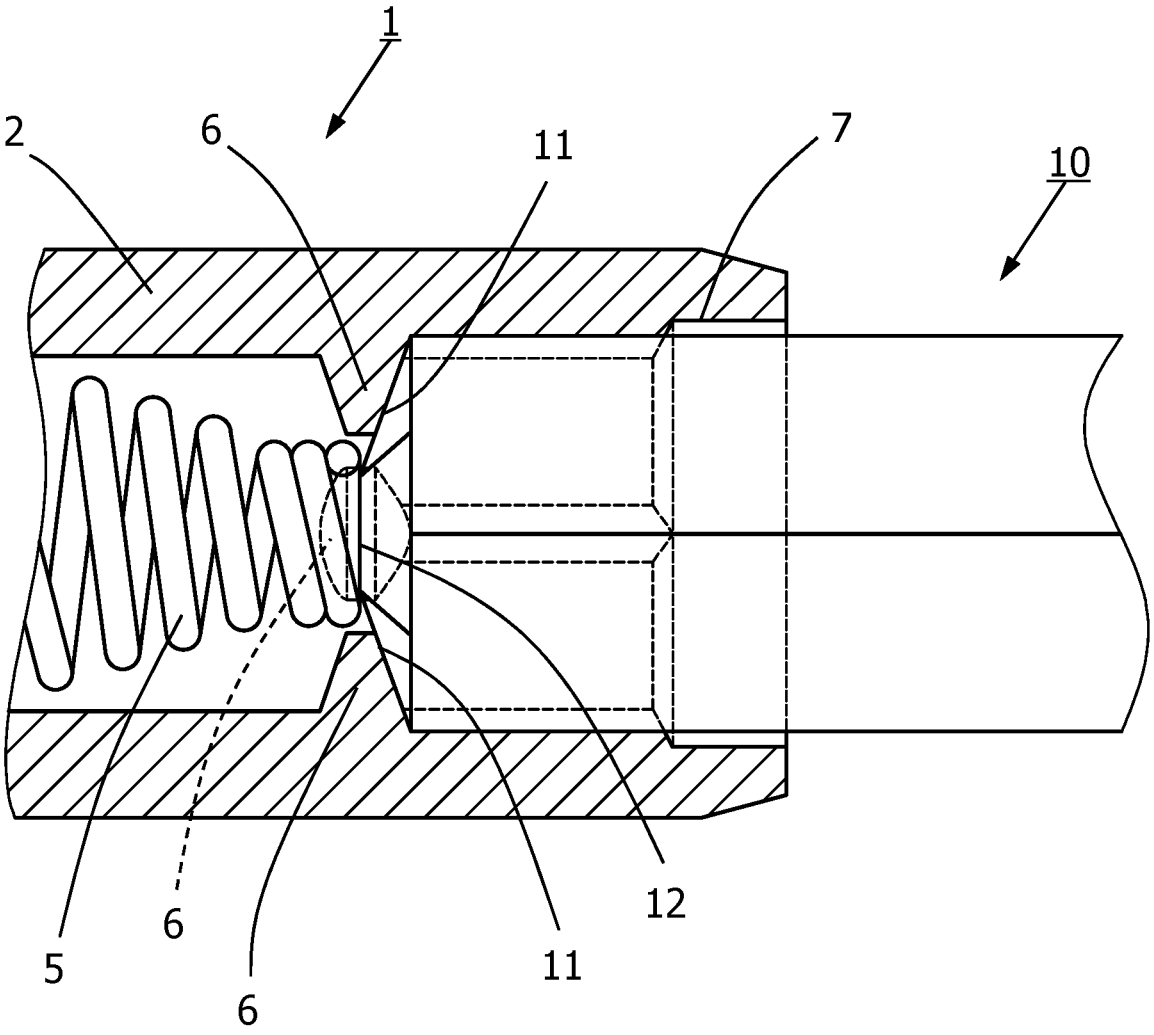
FIG. 3 illustrates a punching of a ball pen tip to assemble a spring into the ball pen tip in the manufacturing method according to the exemplary embodiment.

Next, as illustrated in FIG. 3, a punch 10 is punch-inserted (or press-fitted) from the rear end of the ball pen tip body 2, along the central axis direction. The cross-sectional shape of the punch 10 formed is substantially square. Therefore, four edges that are formed in the circumferential direction of the punch 10 so as to correspond to respective peak portions of the square cross section of the punch 10 come into contact with an inner peripheral wall surface, which has been formed to have a substantially cylindrical shape, of the ball pen tip body 2. Here, a configuration is made such that processing (i.e., punching) energy including the kinetic energy applied per volume of a part to be processed of the ball pen tip body 2, with which the punch 10 comes into contact, is equal to or greater than the processing energy as to meet the conditions that create plastic flow in the material constituting the ball pen tip body 2. The kinetic energy applied to the part to be processed can be increased arbitrarily by increasing a processing (i.e., punching) velocity of the punch 10.

According to this configuration, four ridges 6 are formed due to the plastic flow upheaving radially inward from the inner peripheral wall surface of the ball pen tip body 2. The inventor of the present application has discovered that the amount of radial inward upheaving of the ridges 6 formed due to the plastic flow is maximized by punching with the punch 10 having a square cross-section into the inner peripheral wall surface, which has been formed to have a cylindrical shape, of the ball pen tip body 2, as compared to a case when punching with a punch having another geometric cross-sectional shape such as a triangular or a pentagonal cross-section. According to a plurality of exemplary embodiments of the present disclosure, suitable plastic flow ridges 6 that upheave radially inward by 0.15 mm or more from the inner peripheral wall surface of the ball pen tip body 2 can be formed.

Since the plastic flow ridges 6, which are formed due to the plastic flow and upheave radially inward from the inner peripheral wall surface of the ball pen tip body 2, can be formed by punching with the punch 10 from the rear end of the ball pen tip body 2 along the central axis direction as described above, the spring 5 can be assembled into the ball pen tip 1 by the plastic flow ridges 6. In this case, the ball pen tip 1 can be manufactured with particularly high productivity, as compared to the conventional method for manufacturing ball pen tips in which the entire circumference of the rear end opening of a ball pen tip is swaged radially inward from the direction orthogonal to the axis direction, as with the front end opening of the ball pen tip.

In addition, a flat surface 12 that compresses the spring 5 by pressing the rear end of the spring 5 from the rear to the front is formed at a tip of the punch 10 and inclined surfaces 11 are disposed on sides of the flat surface 12. According to this configuration, at the same time, when the spring 5 is compressed in the axis direction in such a manner that the spring 5 outputs a predetermined set load, the plastic flow ridges 6 can be formed and the spring 5 can be assembled in the ball pen tip 1. Thus, the ball pen tip 1 can be manufactured with even higher productivity, as compared to the conventional method for manufacturing ball pen tips that includes the step of compressing the spring to the set load and then, after a certain amount of time, the step of swaging the rear end opening of the ball pen tip radially inward.

The ball pen tip body 2 has, on the rear side of the inner peripheral wall surface thereof, a guide wall surface 7 having a larger inner diameter than the inner peripheral wall surface of the ball pen tip body 2. The guide wall surface 7 guides a plurality of contact portions, which will come into contact with the inner peripheral wall surface of the ball pen tip body 2, of the punch 10 so that the contact portions come into contact with the inner peripheral wall surface of the ball pen tip body 2 evenly. According to this configuration, in the present exemplary embodiment, each of the four plastic flow ridges 6 can upheave radially inward from the inner peripheral wall surface of the ball pen tip body 2 at a substantially uniform upheaving amount. Consequently, the spring 5 can be assembled into the ball pen tip 1 due to the plastic flow ridges 6 with higher reliability (i.e., quality).

It is preferred that the tip of the punch 10 be formed into a tapered shape such that the tip angle of the punch 10 is within the range of 120 to 170 degrees. Such a configuration can create the suitable plastic flow ridges 6 that upheave in a tapered shape, radially inward from the inner peripheral wall surface of the ball pen tip body 2. The plastic flow ridges 6 that are formed into tapered cantilever upheaving can have sufficient strength to withstand an axial load (and a bending stress caused thereby) applied by the spring 5.

The tip angle of the punch 10 of the present exemplary embodiment is formed to be 135 degrees or around 135 degrees. The inventor of the present application has discovered that the amount of radial inward upheaving of the ridges 6 formed due to the plastic flow is maximized by punching with the punch 10 that is formed to have a tapered tip shape having a tip angle of 135 degrees, as compared to a case when punching with a punch having a tip angle of a different value. In the present exemplary embodiment, suitable plastic flow ridges 6 that upheave radially inward by 0.25 mm or more from the inner peripheral wall surface of the ball pen tip body 2 can be obtained.

The inventor of the present application has also discovered that the plastic flow ridges 6 can be formed while most effectively preventing chipping (e.g., small cracking/dropped away) from occurring at edges (i.e., inner peripheral edges) of the tips of the plastic flow ridges 6 upheaving radially inward from the inner peripheral wall surface of the ball pen tip body 2 when the tip angle of the punch 10 is formed to be 135 degrees or around 135 degrees, as compared with a case when the tip of the punch 10 is formed to have an angle of a different value. Therefore, the spring 5 can be assembled into the ball pen tip 1 by the plastic flow ridges 6 with higher reliability (i.e., quality).

Furthermore, the punch 10 is made of a nonmagnetic material. The punch 10 of the present exemplary embodiment is made of a cemented carbide alloy (e.g., a tungsten carbide alloy sintered using cobalt as a binder). This configuration can prevent fine magnetic powder generated by chipping from the ball pen tip body 2 from adhering to the punch 10 and consequently reducing production reliability, even when the ball pen tip body 2 is formed out of a magnetic material.

The process for manufacturing the ball pen tip described above can include, for example, placing the ball pen tip body 2, to which the writing ball 3 is assembled, in such a manner that the rear end opening of the ball pen tip body 2 faces vertically upward, inserting the pressing ball 4 and the spring 5 into the ball pen tip body 2 by allowing the pressing ball 4 and the spring 5 to drop freely from the rear end opening of the ball pen tip body 2, and punching the ball pen tip body 2 by the punch 10 into the rear end opening of the ball pen tip body 2 vertically from top to bottom to assemble the spring 5. In addition, the ball pen tip may be manufactured by arranging these manufacturing steps in a circumferential direction of a disk-shaped turntable and performing production while rotating the turntable. Such a configuration can achieve a ball pen tip manufacturing machine that implements the highly productive manufacturing method while realizing a compact installation space. Alternatively, other exemplary embodiments may configure a ball pen tip manufacturing machine that implements the highly productive manufacturing method in which these steps are arranged linearly.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein, including the best mode known to the inventors for carrying out the invention. Variations of those exemplary embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The exemplary invention is not limited to the exemplary embodiments detailed above. The specific configuration of each portion can be modified within the range not departing from the purpose of the exemplary invention.

The descriptions of the various exemplary embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A ball pen tip manufacturing machine, comprising:

a punch that punches a ball pen tip from a rear end of the ball tip along a central axis direction of the ball pen tip to form a plastic flow ridge formed by a plastic flow upheaving radially inward from an inner peripheral wall surface of the ball pen tip to assemble a spring to the ball pen tip by the plastic flow ridge, wherein a tip of the punch is formed into a tapered shape and a tip angle of the punch is within a range from 120 degrees to 170 degrees, wherein punching energy including the kinetic energy applied per volume of a part to be processed of the ball pen tip, with which the punch comes into contact, is equal to or greater than the processing energy as to meet the conditions that create the plastic flow ridge in the material constituting the ball pen tip, wherein the spring is assembled for biasing a ball to the ball pen tip, and wherein a front end and a rear end of the spring are wound into a same tapered external shape.

2. The ball pen tip manufacturing machine according to claim 1, wherein the front end and the rear end of the spring comprise the same tapered external shape interposing a central portion of the spring.

3. The ball pen tip manufacturing machine according to claim 1, wherein the front end and the rear end of the spring are wound into the same tapered external shape interposing a central portion of the spring, the central portion of the spring comprising a constant outer diameter.

4. The ball pen tip manufacturing machine according to claim 1, wherein the front end and the rear end of the spring are wound into the same tapered external shape interposing a central portion of the spring, the central portion of the spring having a diameter different than that of the front end and the rear end of the spring.

5. A ball pen tip manufactured by punching the ball pen tip by a punch from a rear end of the ball pen tip along a central axis direction of the ball pen tip to form a plastic flow ridge formed by a plastic flow upheaving radially inward from an inner peripheral wall surface of the ball pen tip to assemble a spring to the ball pen tip by the plastic flow ridge, wherein a tip of the punch is formed into a tapered shape and a tip angle of the punch is within a range from 120 degrees to 170 degrees, wherein punching energy including the kinetic energy applied per volume of a part to be processed of the ball pen tip, with which the punch comes into contact, is equal to or greater than the processing energy as to meet the conditions that create the plastic flow ridge in the material constituting the ball pen tip, wherein the spring is assembled for biasing a ball to the ball pen tip, and wherein a front end and a rear end of the spring are wound into a same tapered external shape.

6. A ball pen that includes the ball pen tip according to claim 5.

7. A ball pen tip, comprising:

a spring for biasing a ball; and a plastic flow ridge formed by a plastic flow upheaving radially inward from an inner peripheral wall surface of the ball pen tip for assembling the spring to the ball pen tip by the plastic flow ridge by punching the ball pen tip by a punch from a rear end of the ball pen tip along a central axis direction of the ball pen tip, wherein a tip of the punch is formed into a tapered shape and a tip angle of the punch is within a range from 120 degrees to 170 degrees, wherein punching energy including the kinetic energy applied per volume of a part to be processed of the ball pen tip, with which the punch comes into contact, is equal to or greater than the processing energy as to meet the conditions that create the plastic flow ridge in the material constituting the ball pen tip, and wherein a front end and a rear end of the spring are wound into a same tapered external shape.

8. A ball pen tip according to claim 7, wherein the plastic flow ridge upheaves radially inward from the inner peripheral wall surface of the ball pen tip to have a tapered shape.

9. A ball pen tip according to claim 7, wherein the plastic flow ridge upheaves radially inward by 0.15 mm or more from the inner peripheral wall surface of the ball pen tip.

10. A ball pen tip according to claim 7, wherein the plastic flow ridge upheaves radially inward by 0.25 mm or more from the inner peripheral wall surface of the ball pen tip.

11. A ball pen tip according to claim 7, wherein the tip angle of the punch is 135 degrees.

12. A ball pen tip according to claim 7, wherein the inner peripheral wall surface of the ball pen tip has a substantially cylindrical shape, and a plurality of ridges, each including the plastic flow ridge, upheaves radially inward from the inner peripheral wall surface of the ball pen tip.

13. A ball pen tip according to claim 12, wherein the plurality of ridges includes four of the plastic flow ridge.

14. A ball pen tip according to claim 12, wherein the plurality of ridges consists of four of the plastic flow ridge.

15. A ball pen tip according to claim 7, further comprising:

a ball pen tip body; and a guide wall surface disposed on a rear side of the inner peripheral wall surface of the ball pen tip, the guide wall surface having a larger inner diameter than the inner peripheral wall surface of the ball pen tip, the guide wall surface guiding a plurality of contact portions that come into contact with an inner peripheral wall surface of the ball pen tip body such that the contact portions come into contact with the inner peripheral wall surface of the ball pen tip body evenly.

16. A ball pen tip according to claim 7, further comprising a front ball that is biased forward by the ball, the front ball being configured for writing.

17. A ball pen including the ball pen tip according to claim 7.

18. The ball pen tip according to claim 7, wherein the front end and the rear end of the spring comprise the same tapered external shape interposing a central portion of the spring.

* * * * *